US008813407B1

(12) United States Patent
Sargent et al.

(10) Patent No.: US 8,813,407 B1
(45) Date of Patent: Aug. 26, 2014

(54) ADJUSTABLE FIREARM REST

(75) Inventors: Craig J. Sargent, Coalville, UT (US); Anthony A. Foster, Brookhaven, MS (US)

(73) Assignee: Craig J. Sargent, Coalville, UT (US)

( * ) Notice: Subject to any disclaimer, the term of this patent is extended or adjusted under 35 U.S.C. 154(b) by 0 days.

(21) Appl. No.: 13/356,550

(22) Filed: Jan. 23, 2012

Related U.S. Application Data

(60) Provisional application No. 61/439,203, filed on Feb. 3, 2011.

(51) Int. Cl.
*F41A 23/56* (2006.01)

(52) U.S. Cl.
USPC ..... 42/94; 89/37.04

(58) Field of Classification Search
USPC ..... 42/85, 90, 94; 89/37.04, 40.06; 81/52, 81/176.1; 211/64, 203; 248/219.4, 221.11, 248/221.12, 222.11, 328, 517, 529, 534
See application file for complete search history.

(56) References Cited

U.S. PATENT DOCUMENTS 758,015 A * 4/1904 Miller ..... 248/125.3
2,953,050 A * 9/1960 Nolen ..... 81/99
3,048,906 A * 8/1962 Patterson ..... 24/16 R
3,425,127 A * 2/1969 Long et al. ..... 33/406
3,576,084 A * 4/1971 Anderson, Jr. ..... 42/94
3,584,821 A * 6/1971 Glebe ..... 248/156
3,856,232 A * 12/1974 Rinaldi ..... 242/146
4,007,554 A * 2/1977 Helmstadter ..... 42/94
4,481,964 A * 11/1984 Minneman ..... 135/66
D276,668 S * 12/1984 Minneman ..... D3/7
4,882,869 A * 11/1989 Webster ..... 42/94
5,205,523 A * 4/1993 Jones ..... 248/218.4
5,410,835 A * 5/1995 Vetter ..... 42/94
5,481,817 A * 1/1996 Parker ..... 248/286.1
5,566,915 A * 10/1996 Hansare ..... 248/188.8
5,634,619 A * 6/1997 Alessi ..... 248/219.3
5,808,227 A * 9/1998 Amos ..... 89/36.01
5,930,931 A * 8/1999 Watson ..... 42/94
6,243,979 B1 * 6/2001 Seats et al. ..... 42/94
6,389,659 B1 * 5/2002 Jacobs ..... 24/573.09
6,543,094 B2 * 4/2003 D'Addario ..... 24/16 PB
6,588,637 B2 * 7/2003 Gates et al. ..... 224/546
6,802,483 B1 * 10/2004 Leasure ..... 248/229.15
D500,650 S * 1/2005 Prais ..... D8/61
6,842,948 B2 * 1/2005 Smith ..... 24/16 R
6,920,713 B1 * 7/2005 Love ..... 42/94
7,107,654 B2 * 9/2006 Byers ..... 24/16 PB
7,594,351 B1 * 9/2009 Walker ..... 42/90
7,784,212 B1 * 8/2010 Chilton ..... 42/94

(Continued)

*Primary Examiner* — Bret Hayes
*Assistant Examiner* — Derrick Morgan
(74) *Attorney, Agent, or Firm* — Morriss O'Bryant Compagni, PC

(57) ABSTRACT

A firearm rest includes a connection portion and a handle portion. The connection portion is configured to connect the firearm rest to an elongate support member when in a connected position, and permit axial movement of the firearm rest along the elongate support member when in a released position. The connection portion includes an aperture and first and second contact portions. The aperture is sized to receive the elongate support member. The first contact portion is positioned at one side of the aperture and arranged to contact the elongate support member. The second contact portion is positioned at an opposite side of the aperture and arranged to contact the elongate support member. The handle portion extends from the connection portion and includes a support surface configured to support a firearm.

18 Claims, 12 Drawing Sheets

(56) References Cited

U.S. PATENT DOCUMENTS

| | | | | |
|---|---|---|---|---|
| 7,971,837 | B1 * | 7/2011 | Wilkinson | 248/218.4 |
| 8,087,195 | B2 * | 1/2012 | Minges | 42/94 |
| 8,113,475 | B2 * | 2/2012 | Whittemore et al. | 248/229.16 |
| 8,132,764 | B2 * | 3/2012 | Kuipers | 248/74.3 |
| 8,215,325 | B2 * | 7/2012 | Montanti | 135/66 |
| 2002/0178637 | A1 * | 12/2002 | Graham | 42/94 |
| 2006/0197000 | A1 * | 9/2006 | Meltzer | 248/219.4 |
| 2008/0172919 | A1 * | 7/2008 | Lackey | 42/94 |

* cited by examiner

ADJUSTABLE FIREARM REST

RELATED APPLICATION

This application claims the benefit of U.S. Provisional App. No. 61/439,203 filed on 3 Feb. 2011, which is hereby incorporated by reference herein in its entirety.

TECHNICAL FIELD

The present application is directed to accessories for use with firearms, and more particularly relates to rest apparatuses for firearms and related methods of use.

BACKGROUND

Shooters often use firearm rests or supports to steady a firearm during target practice, accuracy testing, hunting, etc. Holding a firearm without a stable support may limit the shooter's ability to accurately discharge the firearm. When sighting in a rifle, for example, a shooter typically wants to keep the rifle in the same position for multiple shots so a grouping can be determined. Many shooters accordingly use a support in an attempt to reduce or eliminate human movement inherent in holding a firearm. Some supports are capable of holding the entire firearm. For example, a user may place the forestock of a rifle on a front support and a buttstock of a rifle on a rear support. Other supports may hold only one portion of the firearm. For example, a shooter may hold the buttstock and use a single support for the forestock of the rifle. To provide a desired level of stability, many conventional firearm supports are bulky devices that hold the firearm at a fixed height. Other firearm supports, however, may provide adjustability of the position of the firearm at the front and/or rear support.

One type of gun rest includes a sandbag. Sandbag rests tend to become hard and non-pliable over time. Bipod gun rests attached to the underside of a rifle forearm sometimes tend to get in the way of the shooter. Bipods may require extra manipulation and adjustment when used on uneven ground. The legs may be adjusted for height in order to plumb the sites of the rifle with the horizon. The feet are generally inadequate and tend to grab and jump on hard surfaces, particularly when the shooter attempts to swing in a horizontal motion to engage a target. Portable three and four-legged platforms or frames are also known. These typically require numerous adjustments before they may be arranged to put the gun on target and may slide on the surface on which they rest, may be space-consuming, awkward to use, and are usually time consuming to set up.

Some types of monopod and bipod gun rests include a nail-like protrusion on their feet to be inserted into the ground for stability. Even after being anchored into the ground, such rests sometimes are not stable and tend to rock back and forth.

In some circumstances, a shooter may be carrying the firearm and other equipment such as a camera or scope that is mounted to a stand such as a monopod, bipod, or tripod. The shooter may have limited ability to carry such equipment in addition to carrying the firearm and a firearm rest.

Opportunities exist for improvements in firearm rests and efficiencies in using equipment carried by the shooter in addition to a firearm.

SUMMARY

One aspect of the present disclosure relates to a firearm rest that includes a connection portion and a handle portion. The connection portion is configured to connect the firearm rest to an elongate support member of an independent device such as a leg of a tripod when in a connected position, and permit axial movement of the firearm rest along the elongate support member when in a released position. The connection portion includes an aperture and first and second contact portions. The aperture is sized to receive the elongate support member. The first contact portion is positioned at one side of the aperture and arranged to contact the elongate support member. The second contact portion is positioned at an opposite side of the aperture and arranged to contact an opposite side of the elongate support member. The handle portion extends from the connection portion and includes a support surface configured to support a firearm.

The second contact portion may be adjustable to alter a distance between the first and second contact portions. The second contact portion may be adjustable to accommodate different sized elongate support members in the aperture. The handle portion may extend from the connection portion at an angle of, for example, about 30° to about 60°. The firearm rest may also include a securement member that extends from the connector portion and may be configured to wrap around the elongate support member.

The securement member may include an elastic material. The connector portion may include an entry opening that provides lateral access by the elongate support member into the aperture from a side edge of the connector portion. The second contact portion may be rotatably mounted and adjustable to alter a space between the first and second contact portions to accommodate different sized elongate support members.

Another aspect of the present disclosure relates to a firearm rest configured to mount to a leg of a support structure. The firearm rest includes a base portion having a variable sized aperture accessible from a side edge of the base portion, and a rest member extending from the base portion and having a rest surface configured to support a firearm during shooting.

The base portion may include an adjustable contact member configured to alter a size of the variable sized aperture to accommodate legs of different sizes. The adjustable contact member may be rotatable. The variable sized aperture may include first and second contact surfaces positioned at opposing sides of the variable sized aperture, and the adjustable contact member defines one of the first and second contact surfaces. The rest surface may include a slip resistant material. The rest member may extend from the base portion at an angle of, for example, about 40°. The rest surface may be contoured.

Another aspect of the present disclosure relates to a method of supporting a firearm. The method includes providing a firearm rest comprising a base portion having an aperture accessible from a side edge of the base portion, and a rest member extending from the base portion and having a rest surface. The aperture includes opposed first and second contact surfaces. The method also includes inserting a leg of a support structure into the aperture, contacting the leg against the first and second contact surfaces to releasable fix an axial position of the firearm rest at a location along a length of the leg, and resting a firearm on the rest surface during operation of the firearm.

The base portion may include an adjustable contact member that defines the second contact surface, and the method includes operating the adjustable contact member to adjust a spacing between the first and second contact surfaces to accommodate legs of different sizes. The rest surface may be contoured, and resting the firearm includes cradling the firearm on the contoured rest surface. The firearm rest may include a securement member, and the method includes wrapping the securement member around the leg to provide increased securement of the firearm rest to the leg. The adjustable contact member may include at least two spaced apart contact arms, and operating the adjustable contact member includes rotating the adjustable contact member to position one of the at least two spaced apart contact arms facing the first contact surface.

BRIEF DESCRIPTION OF THE DRAWINGS

The accompanying drawings illustrate a number of embodiments of the instant disclosure and are part of the specification. Together with the following description, the drawings demonstrate and explain principles of the instant disclosure.

Figure 1:
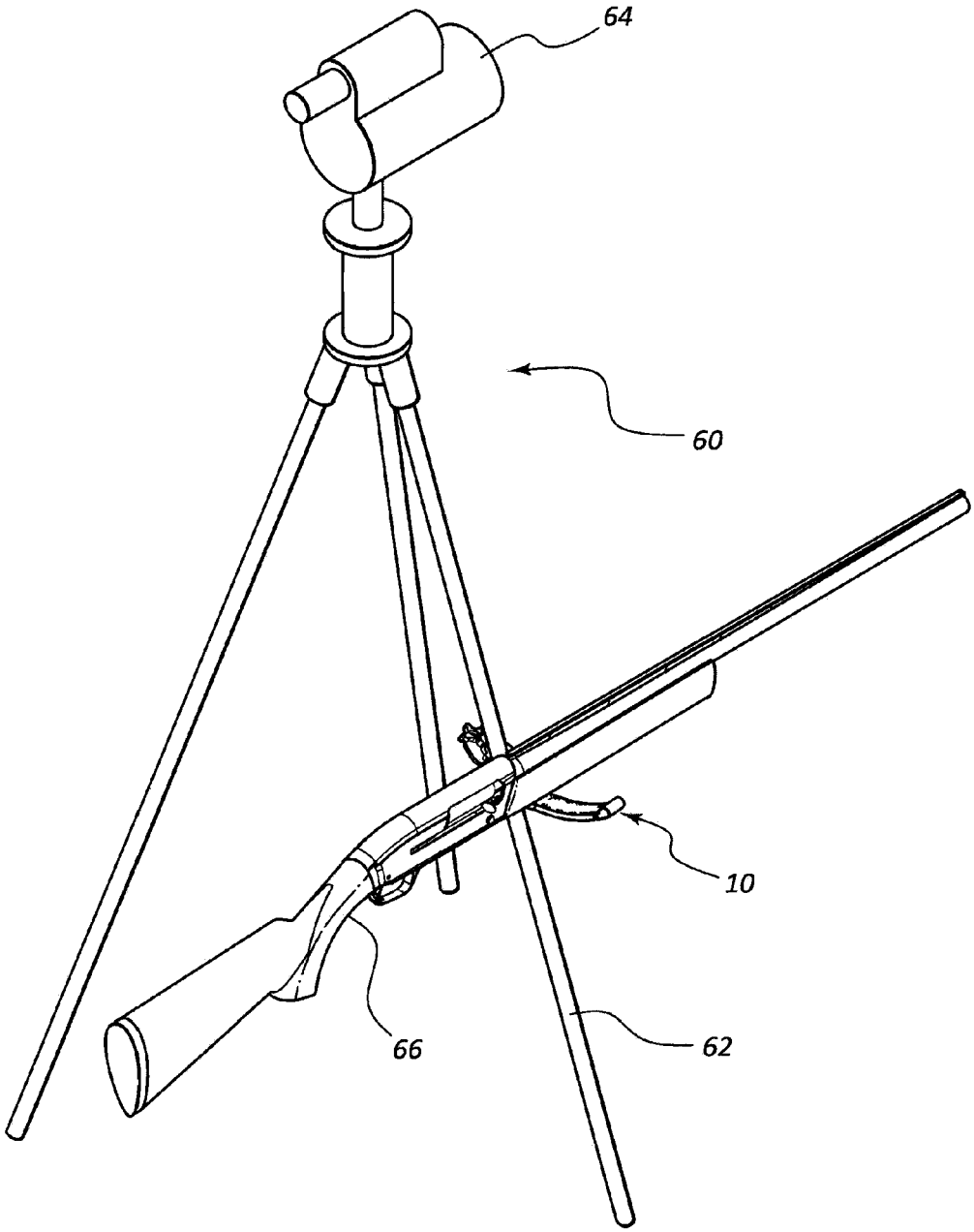
FIG. 1 is a perspective view of an example firearm rest in accordance with the present disclosure that is mounted to a leg of a tripod and supporting a firearm.

Throughout the drawings identical reference characters and descriptions indicate similar, but not necessarily identical, elements. While embodiments of the instant disclosure are susceptible to various modifications and alternative forms, specific embodiments have been shown by way of example in the drawings and will be described in detail herein. However, one of skill in the art will understand that embodiments of the instant disclosure are not intended to be limited to the particular forms disclosed herein. Rather, the instant disclosure covers all modifications, equivalents, and alternatives falling within the scope of embodiments defined by the appended claims.

DETAILED DESCRIPTION

The present disclosure is directed to a firearm rest. The firearm rest may be configured to mount to a support structure such as a leg of a monopod, bipod or tripod. The firearm rest may be adjustable in nature in that the firearm rest may be moveable along a length of the support structure or rotated to any desired position around the support structure. The firearm rest may be adjusted by moving (e.g., rotating) the firearm rest into a released position with limited contact with the support structure so that the firearm rest may move relative to the support structure. The firearm rest may be rotated into a contacting position (e.g., fixed, connecting, or secured position) that provides increased contact and friction with the support structure to help hold the firearm rest in a fixed position relative to the support structure.

In some arrangements, the firearm rest includes a base portion (also referred to herein as a connection portion) and a handle (also referred to herein as a rest member) extending from the base. The base provides an interface with the support structure to provide a releasable connection to the support structure. The handle includes a rest surface upon which the firearm may rest and be supported during use.

The base may include at least one aperture through which at least a portion of the support structure extends. The aperture may include multiple contact portions that define contact surfaces to interface with the support structure. The aperture may be open and accessible from a side edge of the base so that a portion of the support structure may move laterally into the aperture.

The handle may extend at an angle relative to a primary surface of the base. The handle may define a rest or support surface upon which the firearm rests to help stabilize the firearm during use. The handle may have a contoured shape that helps maintain positioning of the firearm on the rest surface. The handle may include a protrusion or lip at a free end thereof that helps retain the firearm on the rest surface. The handle may be sized and configured to apply a rotation force to the base 12 when the base 12 is mounted to the support structure (e.g., leg of a tripod) that helps maintain contact of the contact portions of the aperture with the support structure.

The firearm rest may include an additional securement member that helps maintain positive attachment of the firearm rest to the support structure. The securement member may include, for example, a length of elastic material that wraps around the support structure. The securement member may include a quick release mechanism that provides easy adjustment of the securement member relative to the support structure. The securement member may help secure the firearm rest to the support structure at times when the firearm rest is not in use supporting a firearm. For example, the securement member may help hold the firearm rest assembled to a leg of a tripod when transporting the tripod and when setting up or adjusting the tripod. In other arrangements, the firearm rest is configured to be mounted to the support structure only at the time when the support structure is in a fixed position (e.g., when a tripod is set up) and the firearm rest is intended for use supporting a firearm.

Referring now to FIGS. 1-8B, an example firearm rest 10 is shown and described. The firearm rest 10 is shown in FIG. 1 mounted to a support member 60 that is configured as a tripod. The support member 60 includes a plurality of legs 62. A device 64 may be mounted to and carried by the support member 60. The device 64 may include, for example, a spotting scope, a video device, a camera, camera accessories, or some other instrument or device.

The leg 62 may extend at various angles (e.g., 15° to about 60°) relative to a vertical axis. The leg 62 may have different diameters or other dimensions such as a maximum or minimum thickness or width. The firearm rest 10 may be secured to the leg 62 at any location along a length of the leg 62 and at any rotated position around a circumference of the leg 62. Typically, the firearm rest 10 is mounted to the leg 62 at an orientation such that a firearm 66 is positioned outside of a periphery of the support member 60.

The firearm rest 10 may be configured to mount to many types of support members having different numbers of legs and legs of different construction besides elongate tubular members with a circular cross-section. For example, the support member may be a tree branch, trekking pole, backpack frame or other structure that is sized and shaped to fit within an aperture that defines the contact portions of the firearm rest.

Figure 2:
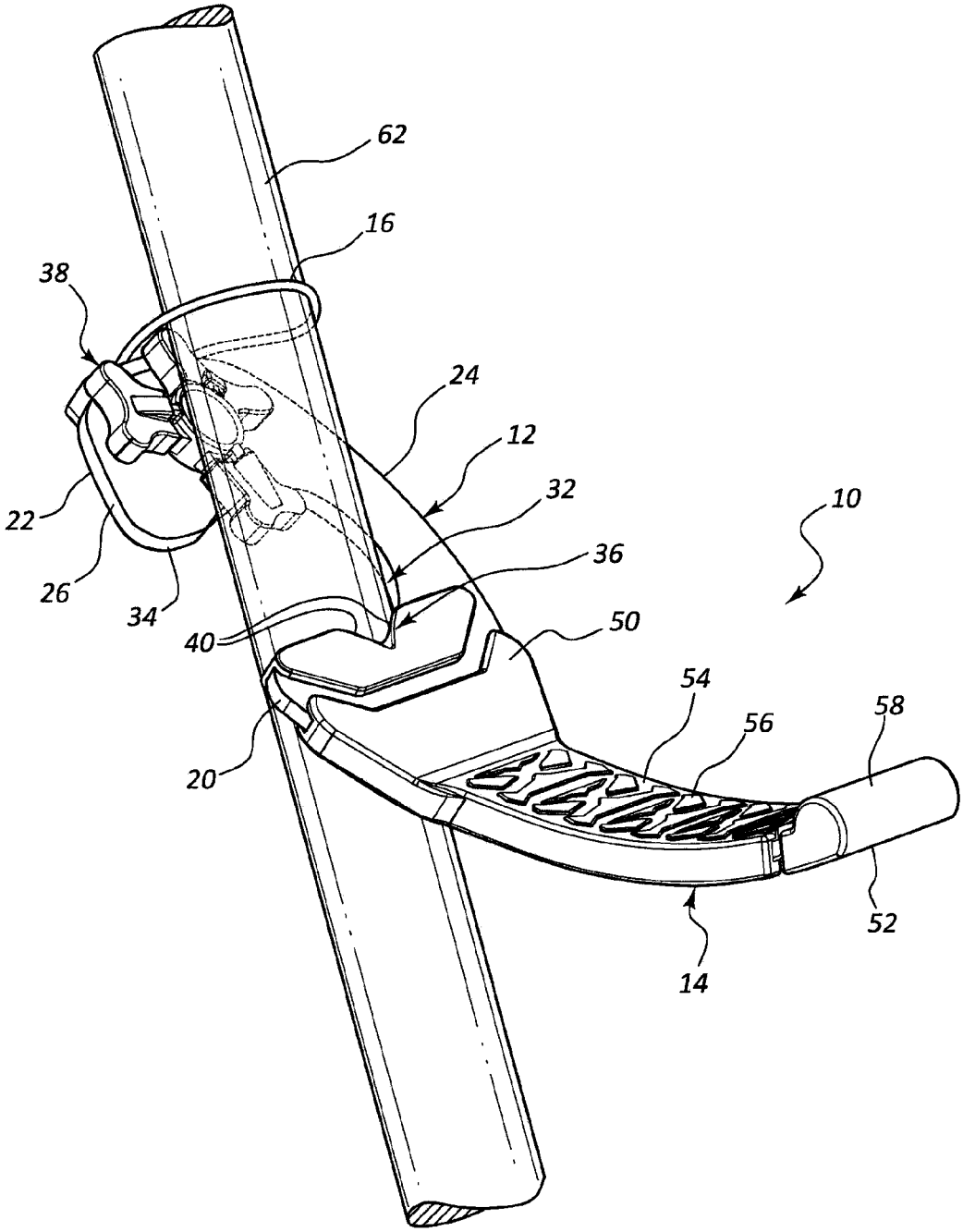
FIG. 2 is a close-up perspective view of the firearm rest of FIG. 1 mounted to a leg of a tripod.

Referring now to FIGS. 2-8B, the firearm rest 10 includes a base 12 and a handle 14. The base 12 is configured to attach to a support member such as a leg 62 of a support member 60 as shown in FIG. 2. The handle 14 may be used to adjust a position of the base 12 relative to the leg 62. The handle 14 may also provide a rest surface upon which a firearm (or other equipment such as a camera, spotting scope, lighting, flashes, cords, light meters, equipment containers, or other devices used with taking pictures or video recording) is supported by or attached to during use.

Figure 3:
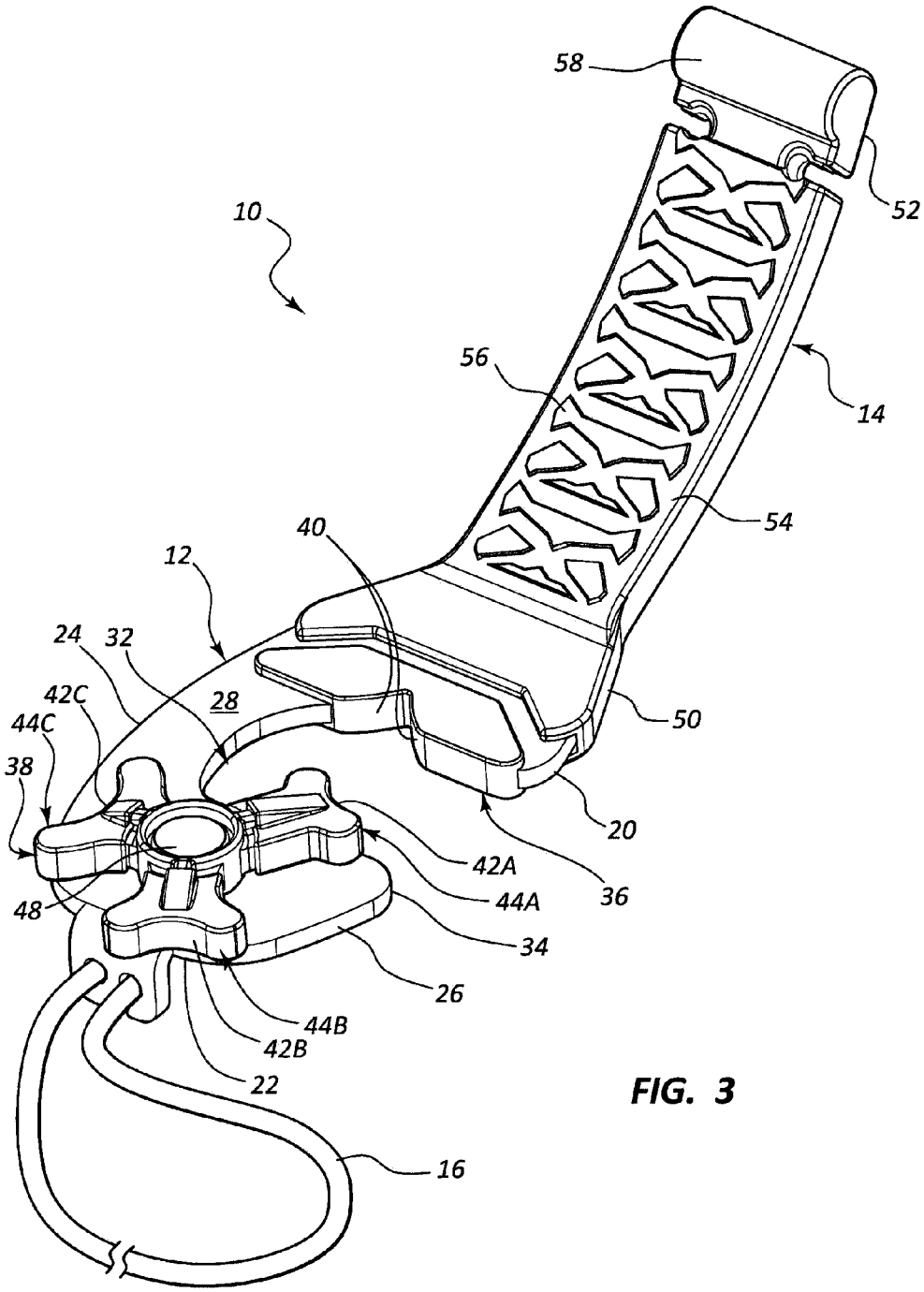
FIG. 3 is another perspective view of the firearm rest of FIG. 1.
Figure 4:
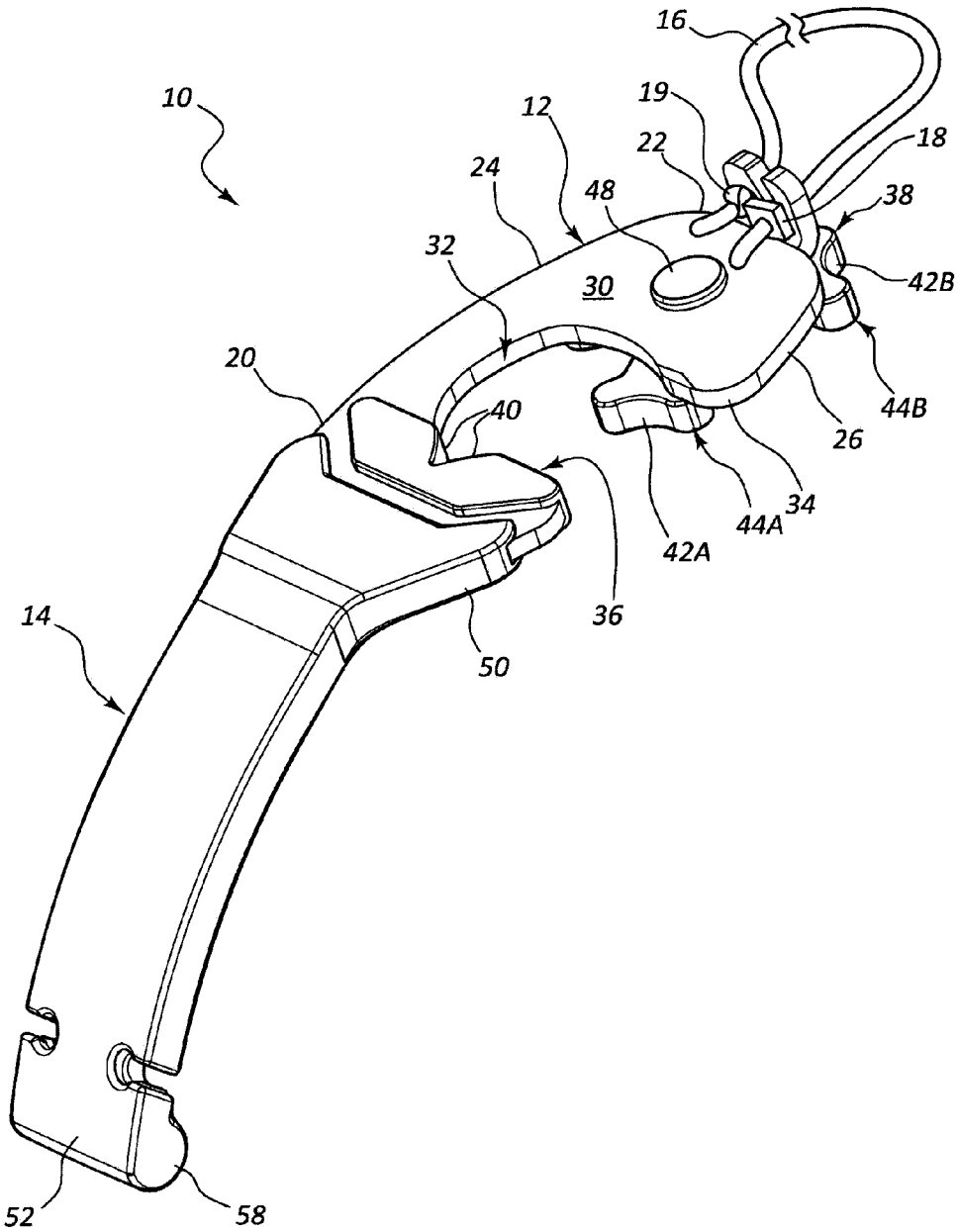
FIG. 4 is a bottom perspective view of the firearm rest of FIG. 1.

Referring to FIGS. 3 and 4, the base 12 includes first and second ends 20, 22, first and second side edges 24, 26, a top surface 28, a bottom surface 30, an aperture 32 and an access opening 34. The handle 14 is typically connected to or extends from the first end 20 of the base 12. The aperture 32 extends from the top surface 28 to the bottom surface 30. The access opening 34 may provide lateral access into the aperture 32 from one of the first and second side edges 24, 26.

Figures 6A, 7A, 8A:
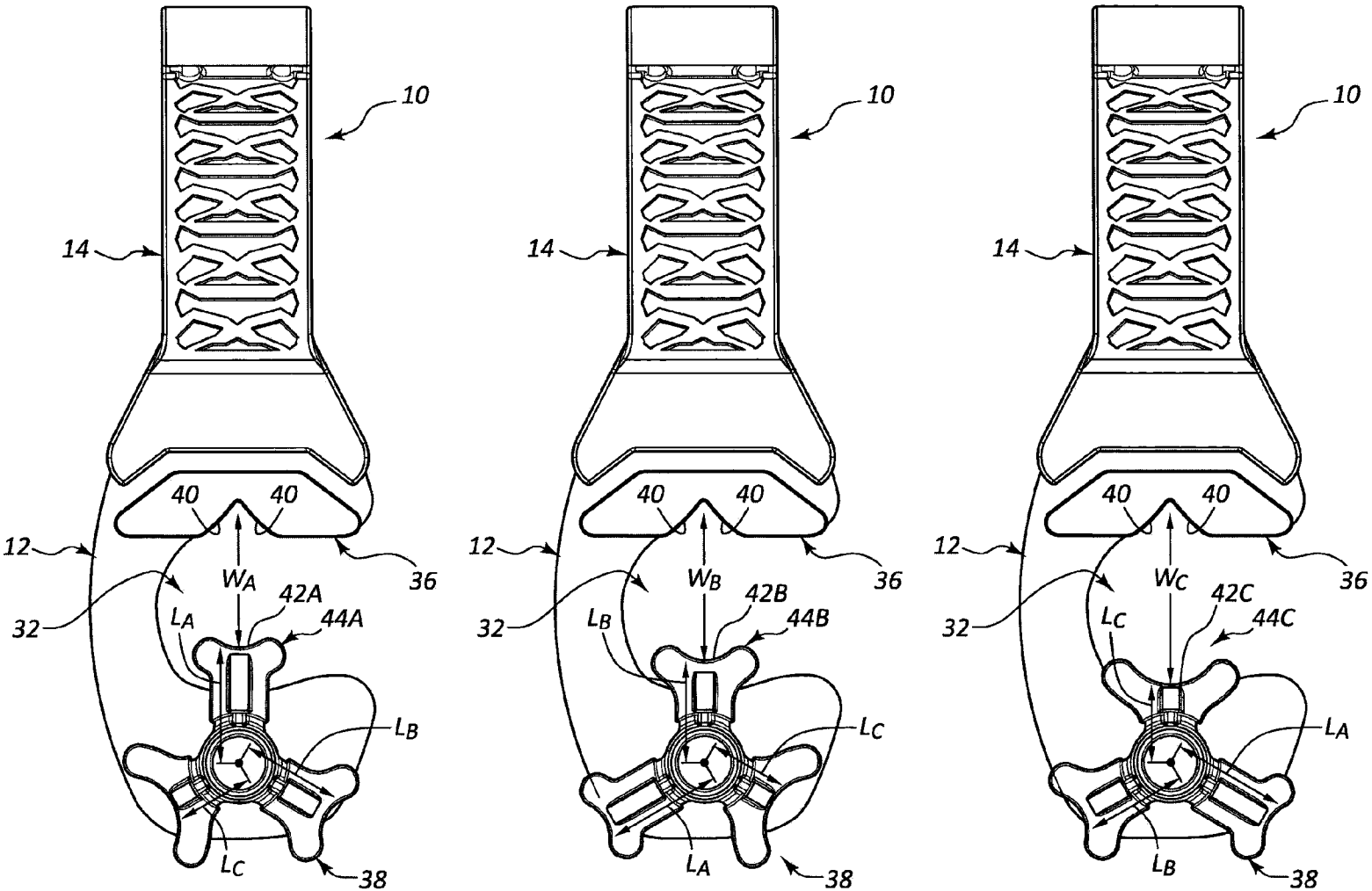
FIGS. 6A, 7A and 8A show the firearm rest of FIG. 1 with an adjustable contact member operated into three different adjusted positions.

The access opening 34 may have a smaller maximum dimension than a maximum dimension of the aperture 32. The aperture 32 may have any desired shape and size. For example, the aperture 32 may have a generally circular shape as shown in FIG. 6A. In other arrangements, the aperture 32 may have alternative shapes such as, for example, square, rectangular, triangular, or hexagonal shapes. Typically the access opening 34 has a sufficient size to permit entry of a portion of a support structure into the aperture 32 regardless of the shape or size of aperture 32.

The aperture 32 may include first and second contact portions 36, 38. The first contact portion 36 may include at least one first contact surface 40. In one example, first contact portion 36 includes a pair of first contact surfaces 40 that converge together at one end of aperture 32. The first contact surfaces 40 may provide a notch or seat within which the support member rests to help hold the support member in a given position within aperture 32. The first contact surfaces 40 may accommodate support members of various diameters.

Second contact portion 38 may include first, second, and third contact arms 44A-C that each define a second contact surface 42A-C. The second contact portion 38 may be mounted to the base 12 at the second end 22. The second contact portion 38 may be rotatable to position one of the first, second and third contact arms 44A-C positioned within or adjacent to the aperture 32 to position one of the second contact surfaces 42A-C facing the first contact portion 36.

Each of the first, second and third contact arms 44A-C may have a different length $L_{A-C}$ measured from a central axis passing through a central opening 46 (see FIG. 5) to the second contact surface 42A-C (see FIG. 6A). Each of the first, second and third contact arms 44A-C defines an aperture effective with $W_{A-C}$ between the first and second contact portions 36, 38, as shown in FIG. 6A, 7A, 8A, respectively. Each of the aperture effective widths $W_{A-C}$ accommodates a different range of sizes for the support member. An operator may rotate the second contact portion 38 to position any one of the first, second and third contact arms 44A-C within the aperture 32 to obtain the desired aperture effective width $W_{A-C}$.

Figure 5:
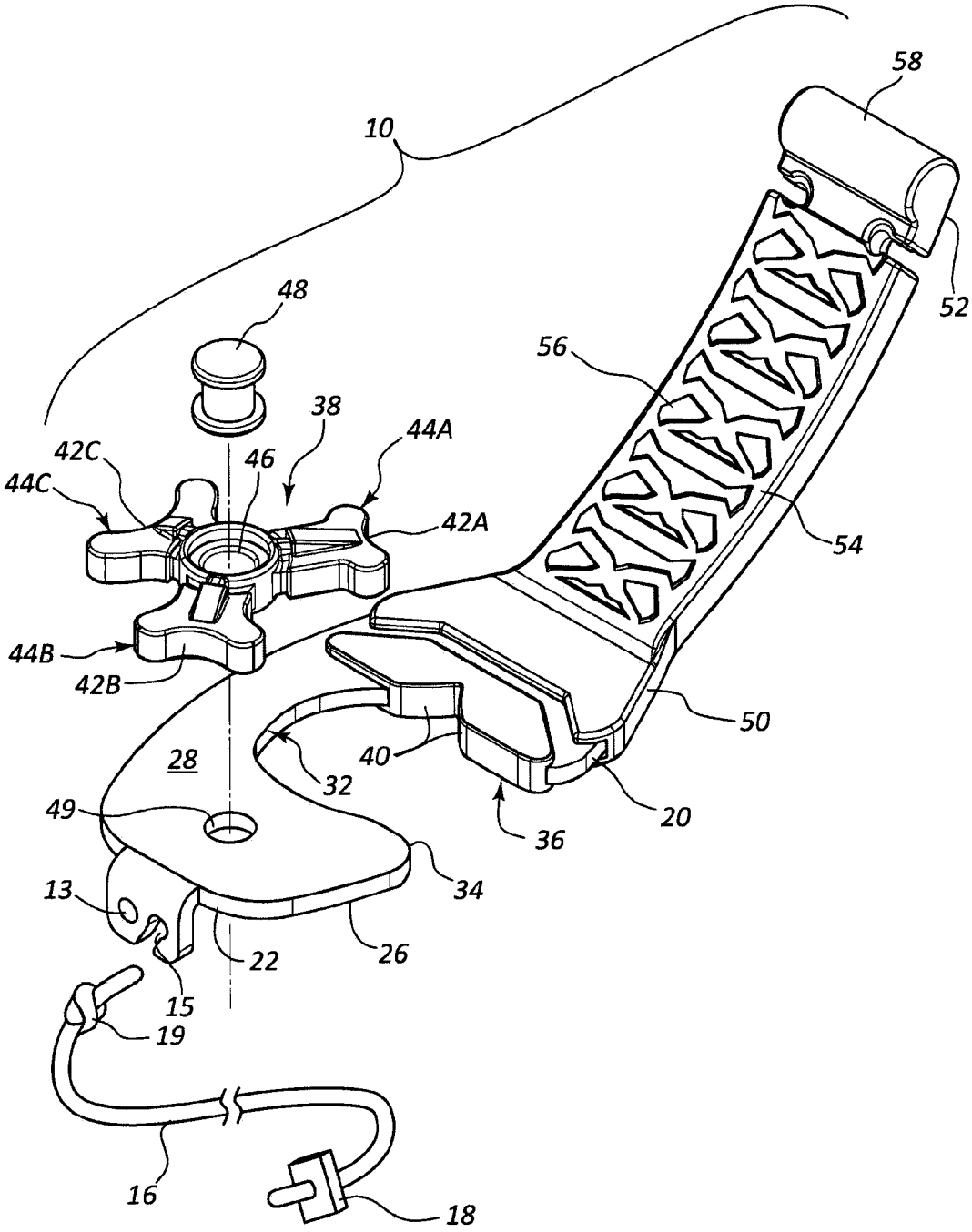
FIG. 5 is an exploded perspective view of the firearm rest of FIG. 1.

The second contact portion 38 may rotate about an axle 48 that extends through the central opening 46 and an axle aperture 49 of base 12 (see FIG. 5). The axle 48, central opening 46, and axle aperture 49 may be constructed to create at least some friction in the assembled firearm rest 10 that helps hold the second contact portion 38 in a given rotated position until acted upon by the operator to rotate the second contact portion 38.

The second contact portion 38 includes three different contact arms that each includes a different length $L_{A-C}$ that defines a different aperture effective width $W_{A-C}$. Further, each of the contact arms has a slightly different shaped second contact surface 42A-C, which may be useful in interfacing with support members of different shapes (e.g., maximum diameters). Other embodiments of the second contact portion 38 may include a different number of contact arms than the three contact arms shown in FIGS. 2-8B. The second contact portion 38 may be replaceable with a different second contact portion having a different number of contact arms or with contact arms having different constructions (e.g., different lengths) than those shown in the figures.

In some arrangements, the second contact portion 38 may be adjusted to position contact arms of different lengths and constructions by other adjustment methods besides rotation. For example, the second contact portion 38 may be slid laterally to position contact arms of different lengths in alignment with the first contact portion 36 within aperture 32. In other arrangements, the second contact portion 38 may be moved vertically (in a perpendicular direction) relative to top surface 28 of base 12, or moved toward or away from the first contact surface 36 in a plane of top surface 28 to alter the effective width between the first and second contact portions 36, 38.

The handle 14 may include first and second ends 50, 52, a rest surface 54, texture 56 positioned on the rest surface 54, and a retaining lip 58 at the second end 52. The texture 56 may provide additional friction that helps hold the firearm in place relative to the rest surface 54. The retaining lip 58 may help retain the firearm on the rest surface 54 by providing a stop surface or protrusion that limits sliding of the firearm off of the second end 52 of the handle 14. The handle 14 may include other structures such as grooves or ribs formed on the rest surface 54 to help hold the firearm on the rest surface 54.

In one example, the base 12 and handle 14 comprise a high strength, relatively stiff material such as metal, metal alloy, or polymer that is continuous from the base 12 to the handle 14. Portions of the base 12 and handle 14 may be overmolded with a second material or a plurality of second materials such as, for example, a high friction material, high wear-resistant material, or corrosion resistant material. Graphics such as logos and text may be molded into the overmolded material or applied directly to the base 12 or handle 14.

Figure 6B:
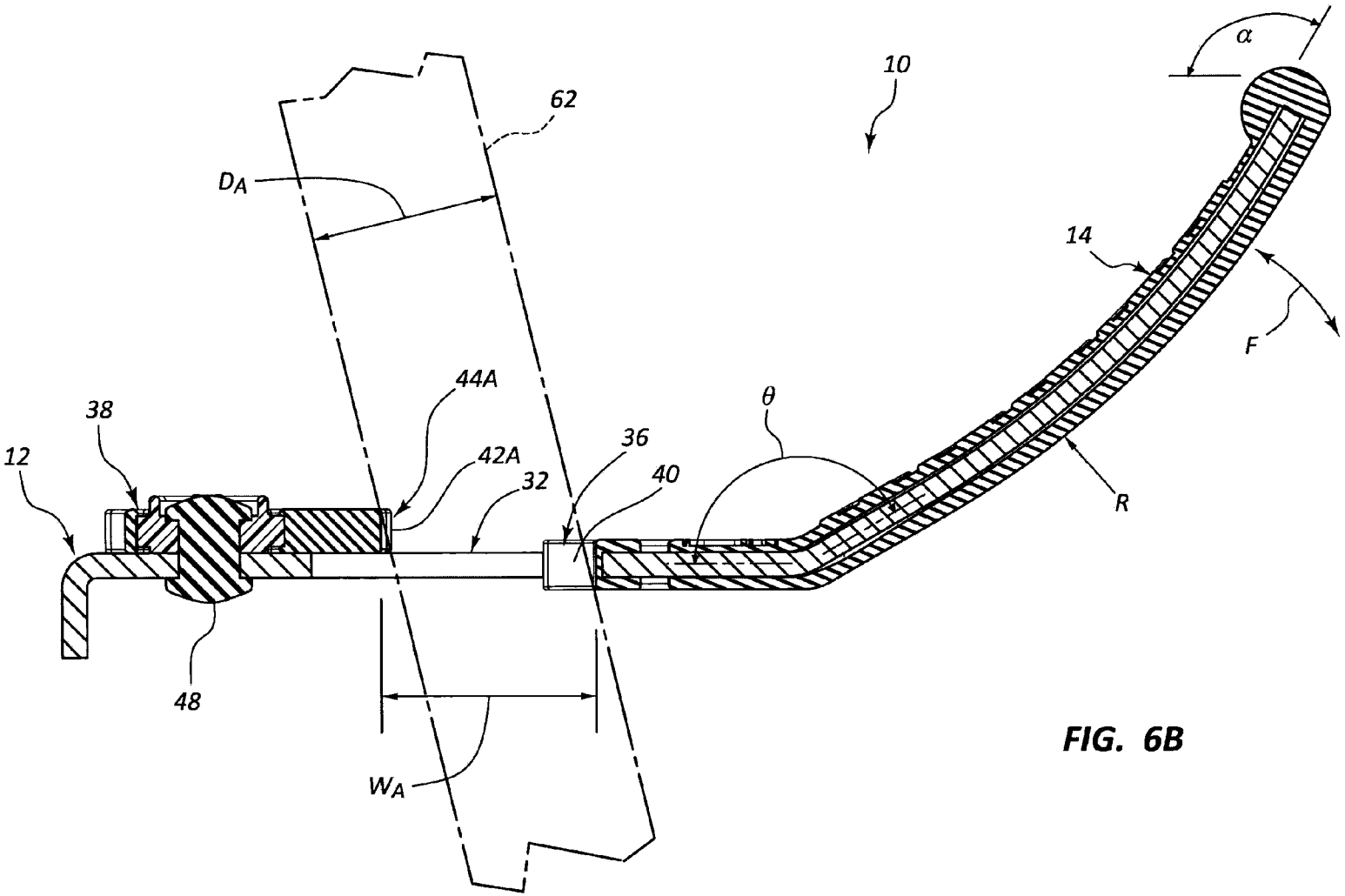
FIGS. 6B, 6C, 7B, 8B show the firearm rest of FIGS. 6A, 7A, 8A mounted to a leg of a support structure.

The rest surface 54 may have a generally contoured shape with a radius R (see FIG. 6B). The curvature of the rest surface 54 may assist in maintaining the firearm on the rest surface 54. The curvature of the rest surface 54 may be referred to as a cradle surface, a concave surface, or a recessed surface that helps hold the firearm or other device on the rest surface 54. In some arrangements, the handle 14 includes a first portion at the first end 50 that is arranged generally parallel with the base 12, and a second portion at the second end 52 that extends at an angle relative to the first portion. In other arrangements, the handle 14 includes only that portion that extends at an angle θ (see FIG. 6B). Typically, the angle θ at which the handle 14 extends relative to base 12 is in the range of about 30° to about 60°, and more preferably about 35° to about 45°. The second end 52 may extend at an angle α relative to base 12 that is less than angle θ due to the curvature of radius R (see FIG. 6B).

Firearm rest 10 may also include a securement member 16 (see FIGS. 2, 4 and 5) that assist in maintaining assembly of the firearm rest 10 with the support member. The securement member 16 may include a stop 18 at a free end thereof and a knot 19 at an opposite end thereof. One end of the securement member 16 is positioned within a first securement member aperture 13 and held in place with a knot 19. The opposite free end of the securement member 16 extends around the support member (e.g., leg 62) as shown in FIG. 2, and back through a second securement member aperture 15 and held in place with stop 18 (see FIG. 4).

The securement member 16 may comprise an elastic material that exerts a variable amount of force on the support member. The elastic properties of the securement member 16 may make it possible to use the securement member 16 with support members of different sizes and shapes. Other types of materials may be used for securement member 16 as understood by those in the art. The securement member 16 may have other constructions besides a single strand of material including, for example, a loop structure as described below with reference to FIGS. 9-12.

In use, the firearm rest 10 is mounted to a support member (e.g., leg 62) by inserting a support member through the access opening 34 and into aperture 32. The operator may adjust the second contact portion 38 to accommodate a particular sized support member that is positioned within aperture 32. The operator may adjust a position of the firearm rest 10 along a length of the support member by lifting the handle 14 up in the rotation direction F (see FIG. 6B) to move the firearm rest 10 between a fixed position contacting the support member with the first and second contact portions 36, 38 (see FIG. 6B), and a release position in which the support member is out of contact with at least one of the first and second contact portions 36, 38 (see FIG. 6C).

The fixed position of FIG. 6B may be maintained by continuing to apply force downward in the rotation direction F. This downward-applied rotation force maintains contact of the first and second contact portions 36, 38 with the support member and provides a friction bind. This friction bind limits sliding movement of the firearm rest 10 along a length of the support member. As more pressure is applied in the downward direction, a leverage pressure may also increase thereby increasing the friction pressure. With this friction pressure applied to create the friction bind, a firearm may then be supported on the rest surface 54 of handle 14 without the firearm rest 10 sliding axially along the length of the support member. Wrapping the securement member 16 around the support member and connecting a free end of the securement member back to the base 12 may help maintain the friction pressure to maintain the friction bind.

Figure 6C:
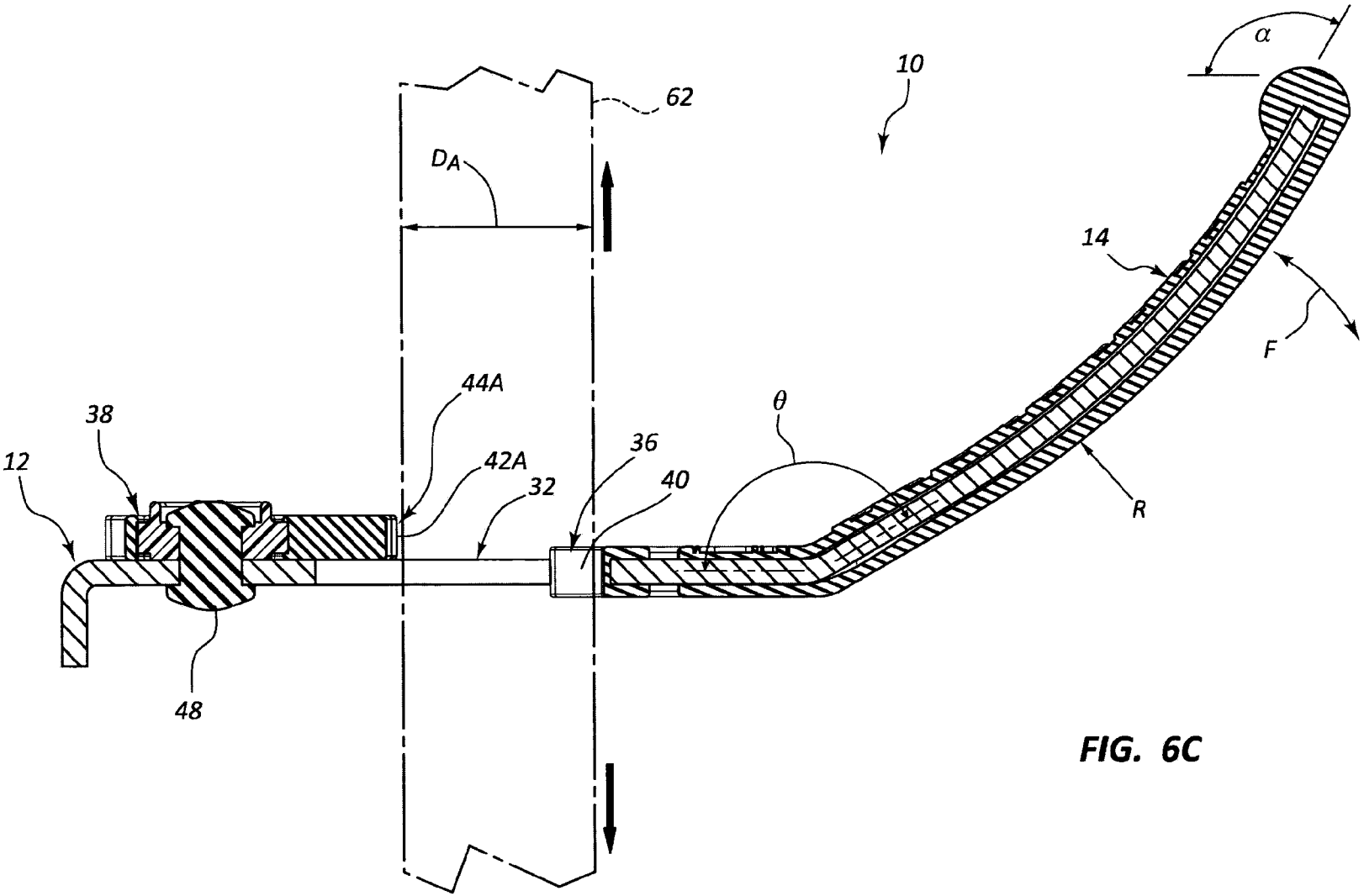
Figure 7B:
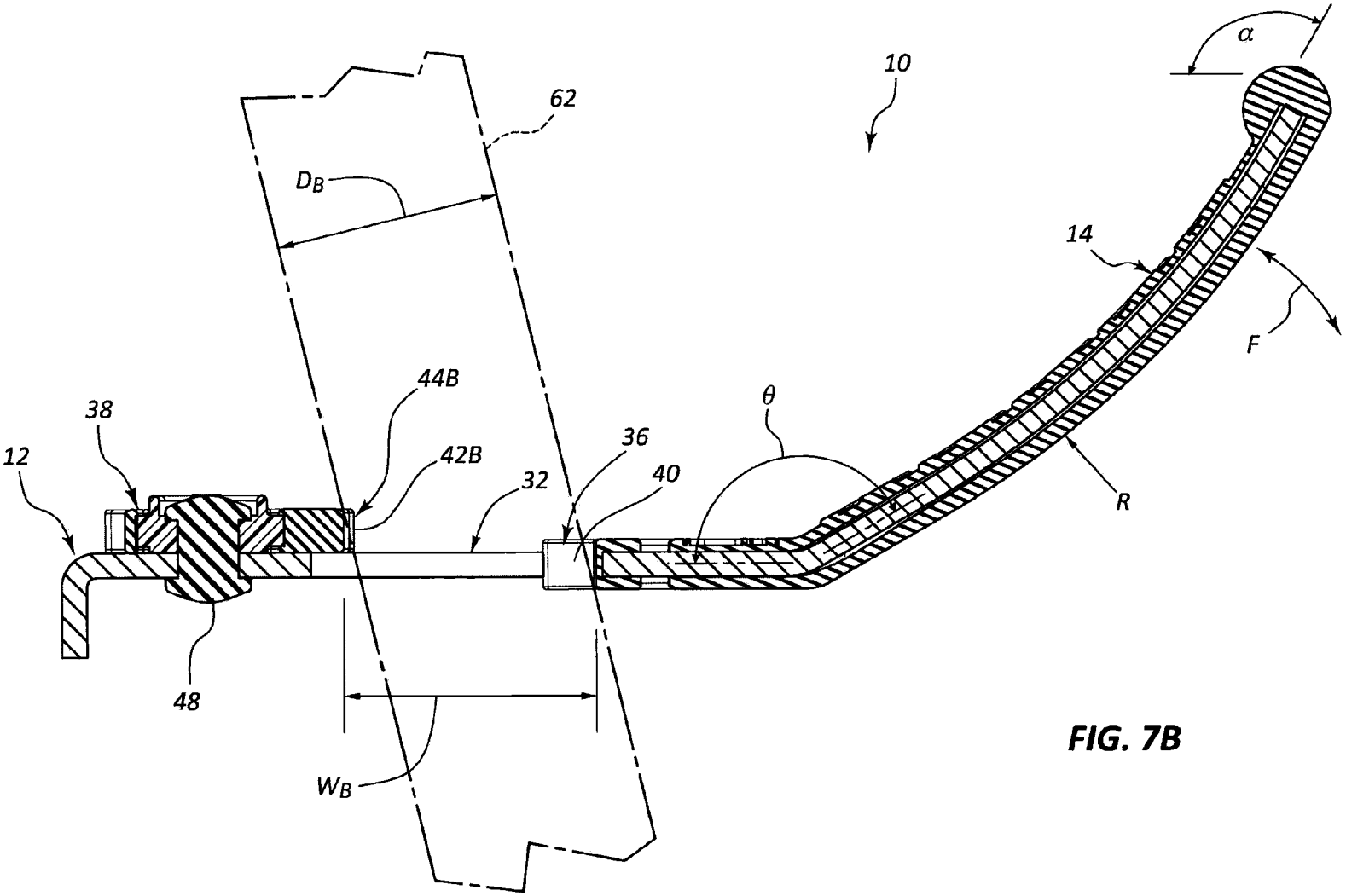
Figure 8B:
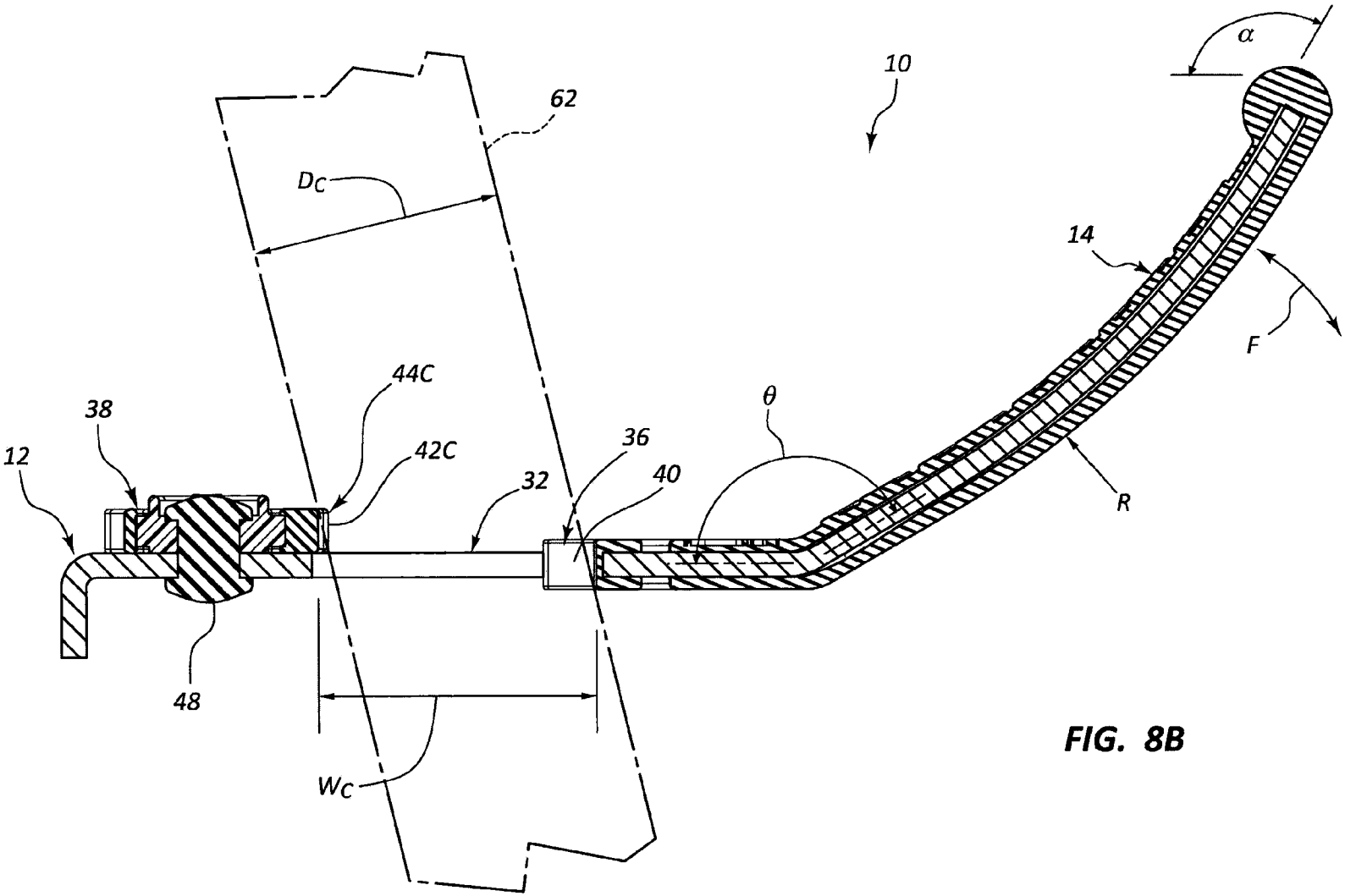
Figure 9:
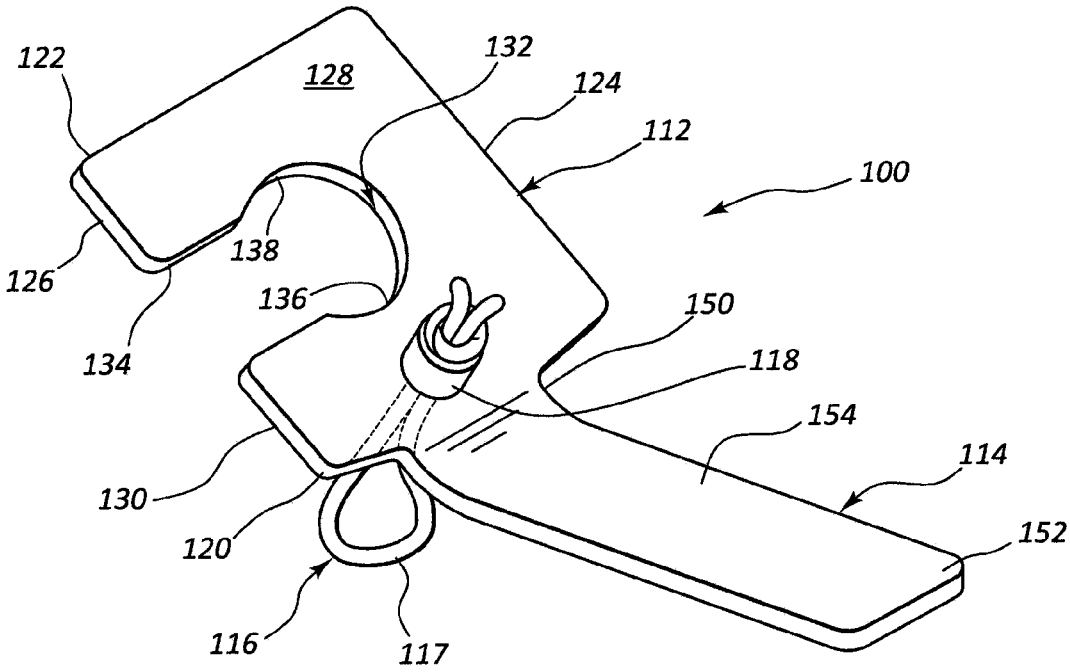
FIG. 9 is a perspective view of another example firearm rest in accordance with the present disclosure.

The friction bind may be released by simply applying a force in the opposite or upward direction F to achieve the release position for firearm rest 10 (see FIG. 6C). The firearm rest 10 may then be moved axially along a length of the support member or rotated relative to a longitudinal axis of the support member. Maintaining connection of the securement member 16 around the support member while the firearm rest 10 is in the released position may help provide at least some positive attachment of the firearm rest 10 to the support member 60, which may be helpful in at least the circumstance where the operator has only one hand available to make adjustment of the firearm rest 10.

Referring now to FIGS. 6A-8B, the firearm rest 10 is shown in various adjusted positions for the second contact portion 38 to accommodate legs 62 of different dimensions $D_{A-C}$. A constant angled orientation of the firearm rest 10 relative to the leg 62 may be maintained regardless of the change in diameter $D_{A-C}$ by using different adjusted positions for the second contact portion 38. Alternatively, different angled orientations for the firearm rest 10 relative to a leg 62 of constant diameter may be possible by adjusting the second contact portion 38 to use one of the first, second and third contact arms 44A-C.

Referring now to FIGS. 9-12, another example firearm rest 100 is shown and described. The firearm rest 100 includes a base 112, a handle 114, and a securement member 116. The securement member 116 is attached to the base 112 at a first securement member aperture 113 (see FIG. 10). The securement member 116 may be mounted an opposite end of the base 12 as compared to attachment of the securement member 16 described above with reference to firearm rest 10.

Base 112 includes first and second ends 120, 122, first and second side edges 124, 126, top and bottom surfaces 128, 130, an aperture 132, and an access opening 134. The aperture 132 may include first and second contact portions 136, 138 along opposing surfaces or edges of the aperture 132. The aperture 132 has an aperture effective width $W_1$ defined between the first and second contact portions 136, 138. The first and second contact portions 136, 138 define first and second contact surfaces, respectively, that contact a support member (e.g., leg 62 shown in FIGS. 11-12) during use.

The handle 114 includes first and second ends 150, 152 and a rest surface 154. The handle 114 extends at an angle θ relative to base 112. The handle 114 may be unitary and continuous with the base 112. At least portions of the base 112 and handle 114 may be covered with a second material (e.g., overmold) that comprises, for example, a high-friction, a wear resistant, or a corrosion resistant material. Providing a high-friction material at least in the area surrounding aperture 132 may assist in providing a high friction interface between firearm rest 100 and the support member.

Figure 11:
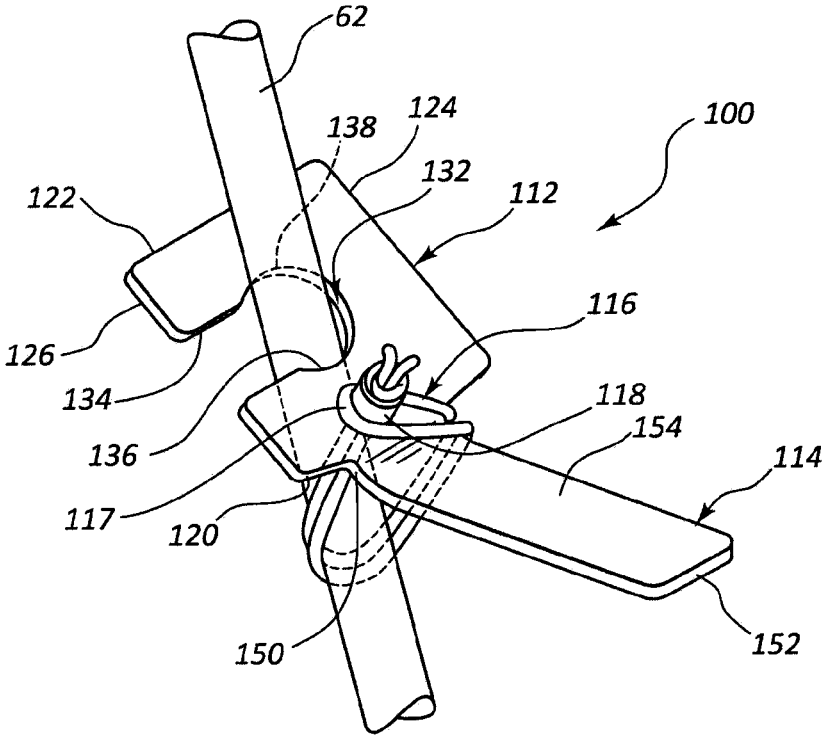
FIG. 11 is a perspective view of the firearm rest of FIG. 9 mounted to a leg of a support structure.
Figure 12:
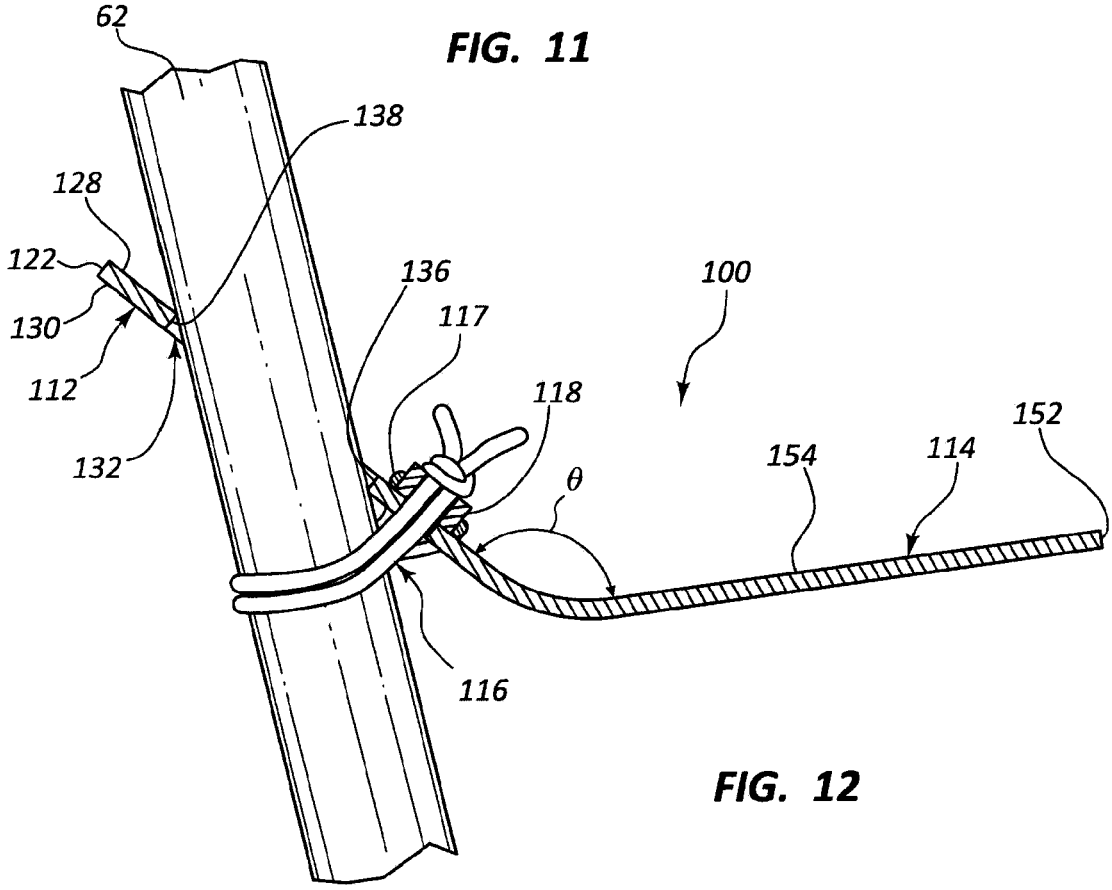
FIG. 12 is a side view of the firearm rest of FIG. 11.

Securement member 116 may be arranged with a loop having a stop 118 at one end and a loop 117 at an opposing end. The loop 117 may be passed through the first securement member aperture 113 and the stop 118 positioned adjacent to base 112. The loop end 117 may wrap around the support member (e.g., around leg 62 as shown in FIGS. 11-12) and connected to stop 118. In some arrangements the securement member 116 may be wrapped around leg 62 multiple times before connecting loop end 117 to stop 118. Securement member 116 may comprise any of the materials discussed above related to securement member 16. Securement member 116 may have a single strand construction as opposed to the dual strand construction shown in FIGS. 9-12. Other types of securement member devices may be used including, for example, straps, hooks, snaps, buckles, and cords that comprise any desired material and construction to provide a releasable secondary attachment of firearm rest 100 to a support member.

Figure 10:
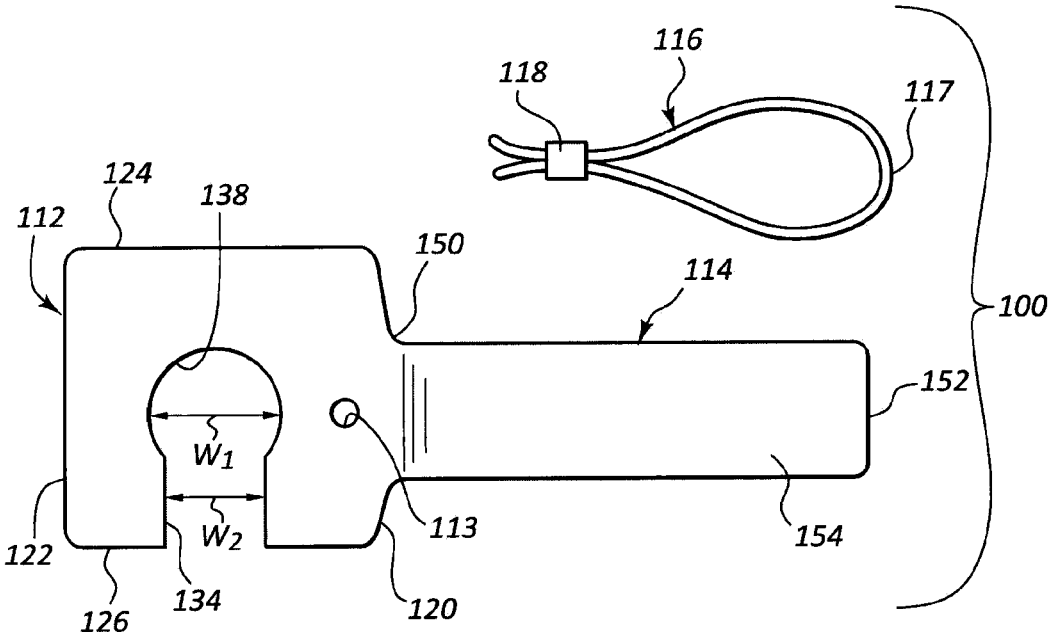
FIG. 10 is an exploded view of the firearm rest of FIG. 9.

The aperture effective width $W_1$ may be greater than an access opening width $W_2$ (see FIG. 10). In one example, access opening width $W_2$ is in the range of about 0.5 inches to about 3 inches, and more preferably in the range of about 0.75 inches to about 1.5 inches. The aperture effective width $W_1$ may be in the range of about 0% to about 100% greater than width $W_2$, and more preferably in the range of about 0% to about 25% greater than width $W_2$. Many shapes and sizes are possible for aperture 132 and access opening 134 to accommodate support members of sizes either greater than or less than the range of sizes described for widths $W_1$ and $W_2$.

The firearm rests disclosed herein may provide an adjustable firearm rest that provides relatively easy attachment and detachment from a support member such as a leg of a tripod, and relatively easy positional adjustment of the firearm rest relative to the support member (e.g., a change in height or rotated position relative to the support member). The firearm rest may be relatively small in size to enhance portability and storage (e.g., small enough to store in a user's pocket). In some arrangements, the firearm rest may be permanently assembled with the support member and be adjustable rotationally or axially relative to the support member. While the examples disclosed herein include an access opening to an aperture of the firearm rest within which the support member is positioned, other embodiments are void of an access opening such that the firearm rest is mounted to the support member by inserting the support member directly through the aperture in an axial direction rather than laterally through the access opening.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive, and that reference be made to the appended claims and their equivalents for determining the scope of the instant disclosure. In addition, for ease of use, the words "including" and "having," as used in the specification and claims, are interchangeable with and have the same meaning as the word "comprising."

What is claimed is:

1. A firearm rest, comprising:

a connection portion configured to connect the firearm rest to an elongate support member when in a connected position, and permit axial movement of the firearm rest along the elongate support member when in a released position, the connection portion comprising: an aperture sized to receive the elongate support member;

a first contact portion positioned at one side of the aperture and arranged to contact the elongate support member;

a second contact portion positioned at an opposite side of the aperture and arranged to contact the elongate support member;

a handle portion extending from proximate the second contact portion of the connection portion and having a support surface configured to support a firearm;

a securement member coupled to the connection portion opposite one of the first contact portion and the second contact portion and forming a loop configured to wrap around the elongate support member, the securement member comprising an elongate elastic member capable of exerting a biasing force between the elongate support member and the firearm rest to cause a friction bind between the first and second contact portions with the elongate support member, with the first contact portion upwardly biased relative to the elongate support member and the second contact portion downwardly biased relative to the elongate support member in order to maintain the connected position of the firearm rest relative to the elongate support member when the firearm rest is not supporting a firearm; and a stop coupled to the elongate elastic member opposite the loop and the stop coupled to the connection portion for preventing the securement member from being dislodged from the firearm rest when the elongate elastic member is exerting a biasing force between the elongate support member and the firearm rest to cause the friction bind between the first and second contact portions with the elongate support member.

2. The firearm rest of claim 1, wherein the second contact portion is adjustable to alter a distance between the first and second contact portions.

3. The firearm rest of claim 1, wherein the second contact portion is adjustable to accommodate different sized elongate support members in the aperture.

4. The firearm rest of claim 1, wherein the handle portion is upwardly angled from the connection portion at an angle of about 30° to about 60°.

5. The firearm rest of claim 1, wherein the connection portion includes an entry opening that provides lateral access by the elongate support member into the aperture from a side edge of the connection portion.

6. The firearm rest of claim 1, wherein the second contact portion is rotatably mounted and adjustable to alter a space between the first and second contact portions to accommodate different sized elongate support members.

7. A firearm rest configured to mount to a leg of a support structure, comprising:

a base portion having an aperture accessible from a side edge of the base portion sized to be receive a leg of a support structure;

a rest member extending from the base portion and having a rest surface configured to support a firearm during shooting;

an elongate elastic securement member coupled to the base portion and forming a loop configured to wrap around the leg of the support structure and to exert a biasing force between the leg and the firearm rest to cause a friction bind between first and second opposite sides of the aperture and the leg of the support member, with the first opposite side of the aperture opposite the rest member upwardly biased relative to the leg of the support structure and the second opposite side nearest the rest member downwardly biased relative to the elongate support member in order to maintain the connected position of the firearm rest relative to the leg when the firearm rest is not supporting a firearm; and a stop coupled to the elongate elastic securement member opposite the loop and the stop coupled to the base portion for preventing the securement member from being dislodged from the firearm rest when the elongate elastic member is exerting a biasing force between the elongate support member and the firearm rest to cause the friction bind between the first and second contact portions with the elongate support member.

8. The firearm rest of claim 7, wherein the base portion includes an adjustable contact member configured to alter a size of the aperture to accommodate legs of different sizes.

9. The firearm rest of claim 8, wherein the adjustable contact member defines a plurality of contact surfaces rotatable in a plane substantially perpendicular to a plane defined by the aperture.

10. The firearm rest of claim 8, wherein the aperture is a variable sized aperture having first and second contact surfaces positioned at opposing sides of the variable sized aperture, the adjustable contact member defining one of the first and second contact surfaces.

11. The firearm rest of claim 7, wherein the rest surface comprises a slip resistant material.

12. The firearm rest of claim 7, wherein the rest member is upwardly angled from the base portion at an angle of about 40°.

13. The firearm rest of claim 7, wherein the rest surface is contoured.

14. A method of supporting a firearm, comprising:

providing a firearm rest comprising a base portion having an aperture accessible from a side edge of the base portion sized to be receive a leg of a support structure, and a rest member extending from the base portion and having a rest surface, the aperture having opposed first and second contact surfaces;

inserting the leg of the support structure into the aperture;

contacting the leg against the first and second contact surfaces to releasably fix an axial position of the firearm rest at a location along a length of the leg;

wrapping an elastic securement member in the form of a loop coupled to the base portion around the leg of the support structure to exert a biasing force between the leg and the firearm rest to cause a friction bind between first and second opposite sides of the aperture and the leg of the support member, the elastic securement member having a stop coupled thereto opposite the loop and the stop coupled to the base portion for preventing the securement member from being dislodged from the arm rest when the elongate elastic member is exerting a biasing force between the elongate support member and the firearm rest to cause the friction bind between the first and second contact portions with the elongate support member, with the first opposite side of the aperture opposite the rest member upwardly biased relative to the leg of the support structure and the second opposite side nearest the rest member downwardly biased relative to the elongate support member in order to maintain the fixed axial position of the firearm rest relative to the leg when the firearm rest is not supporting a firearm; and resting a firearm on the rest surface during operation of the firearm.

15. The method of claim 14, further comprising providing the base portion with an adjustable contact member that defines the second contact surface and operating the adjustable contact member to adjust a spacing between the first and second contact surfaces to accommodate legs of different sizes.

16. The method of claim 14, further comprising providing a contoured rest surface and resting the firearm includes cradling the firearm on the contoured rest surface.

17. The method of claim 16, further comprising coupling the securement member between the base portion and the leg to provide increased securement of the firearm rest to the leg.

18. The method of claim 15, further comprising providing the adjustable contact member with at least two spaced apart contact arms, and operating the adjustable contact member includes rotating the adjustable contact member to position one of the at least two spaced apart contact arms facing the first contact surface.

* * * * *